United States Patent [19]

Nieman

[11] 4,030,797

[45] June 21, 1977

[54] ELECTRICAL CONNECTOR

[75] Inventor: Gerald R. Nieman, Phoenix, Ariz.

[73] Assignee: International Telephone and Telegraph Corporation, New York, N.Y.

[22] Filed: July 12, 1976

[21] Appl. No.: 704,316

Related U.S. Application Data

[63] Continuation of Ser. No. 585,878, June 11, 1975.

[52] U.S. Cl. ..... 339/64 M; 339/186 M

[51] Int. Cl.[2] ..... H01R 13/62

[58] Field of Search ..... 339/64–66, 339/186

[56] References Cited

UNITED STATES PATENTS

| | | | |
|---|---|---|---|
| 3,025,489 | 3/1962 | August | 339/64 M |
| 3,047,828 | 7/1962 | Gregson et al. | 339/64 R |
| 3,088,089 | 4/1963 | Gregoire | 339/64 R |
| 3,094,364 | 6/1963 | Lingg | 339/64 M |
| 3,287,031 | 11/1966 | Simmons et al. | 339/65 |
| 3,566,334 | 2/1971 | Ziegler, Jr. | 339/64 M |
| 3,897,125 | 7/1975 | Anderson | 339/64 R |

*Primary Examiner*—Joseph H. McGlynn
*Attorney, Agent, or Firm*—Thomas L. Peterson

[57] ABSTRACT

An electrical connector including a housing having an axis, a receptacle, a tube-like plug shell and apparatus for mounting the plug shell inside the housing in a manner to translate in either or both of two different directions, in a manner to rotate about the housing axis, and in a manner to tilt about the housing axis. The plug shell also has a flared end portion to receive the receptacle. The plug shell carries a socket in a throat portion thereof, and the receptacle carries one or more pins to be mated to the socket. The plug shell thus is capable of moving relative to the housing in substantially an infinite number of paths to accommodate mating when the receptacle has any one of a great number of positions and entry angles and paths into the flared end portion of the receptacle. Proper mating under these circumstances is made possible in spite of any misalignment and in locations of moderate or extreme inaccessibility or under other difficult circumstances.

1 Claim, 10 Drawing Figures

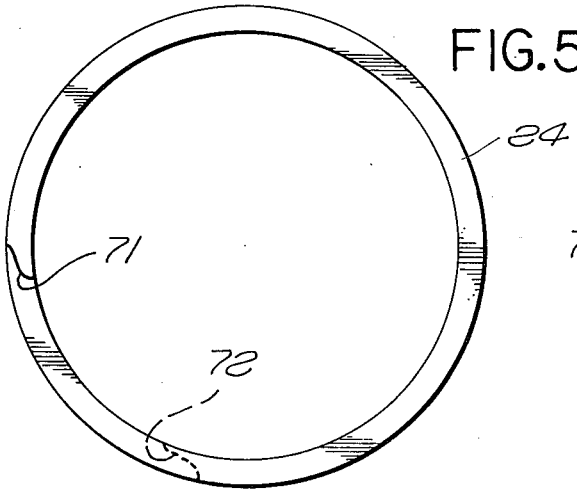
FIG.5.
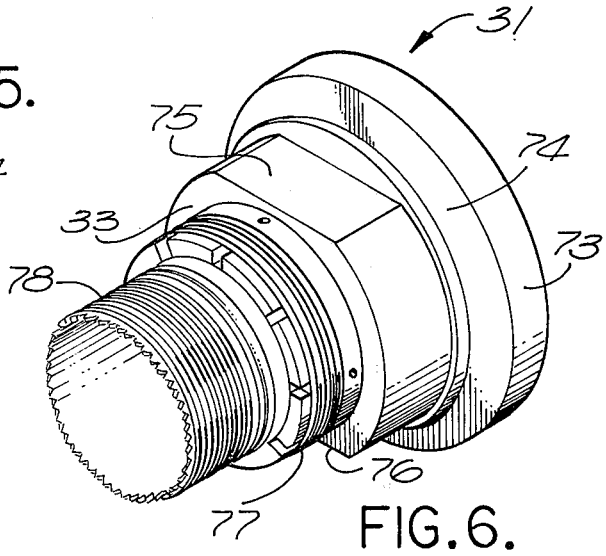
FIG.6.
FIG.7.
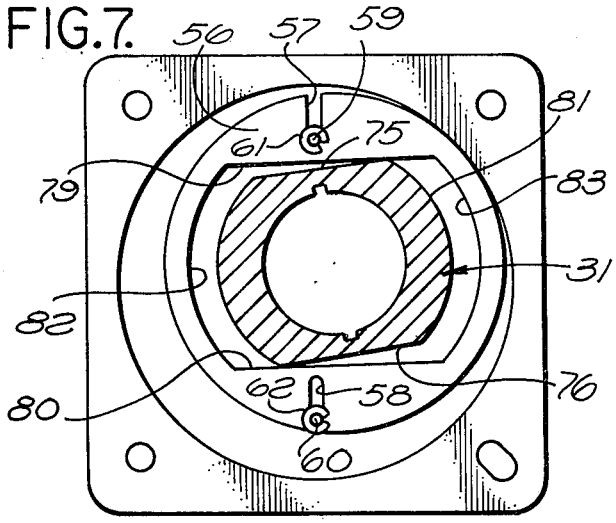
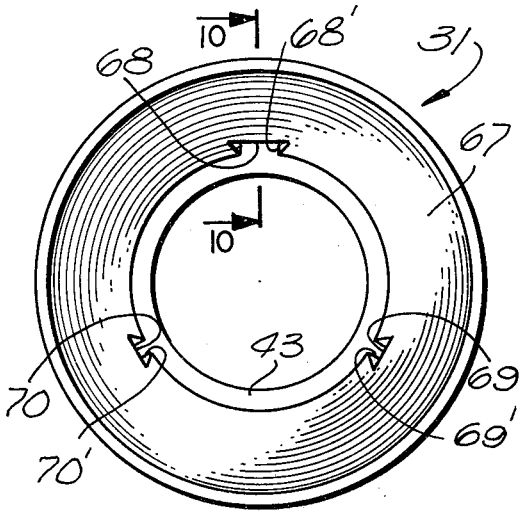
FIG.9.
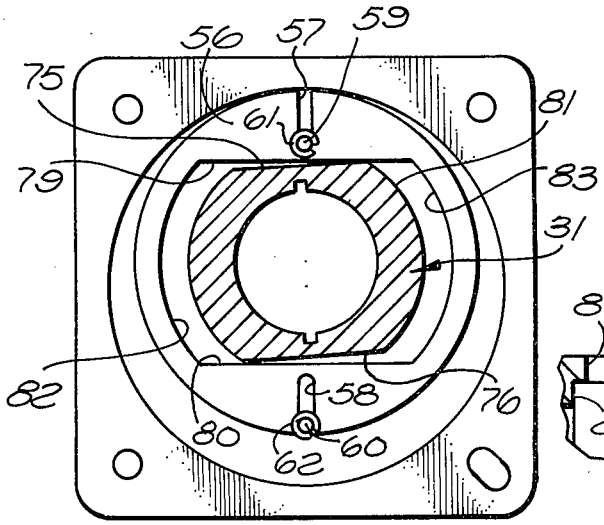
FIG.8.
FIG.10.
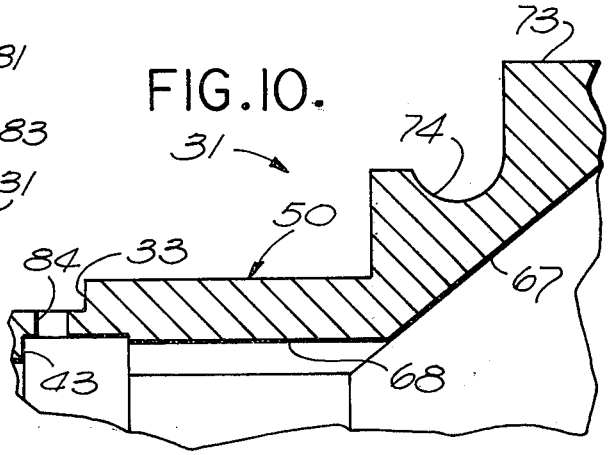

ELECTRICAL CONNECTOR

This application is a continuation of copending application Ser. No. 585,878 filed June 11,1975, for ELECTRICAL CONNECTOR by G. R. Nieman. In accordance with the foregoing, the benefit of the filing date of said application Ser. No. 585,878 is hereby claimed for this application.

BACKGROUND OF THE INVENTION

This invention relates to electrical devices, and more particularly to an electrical connector which permits the mating of a receptacle and its counterpart where the initial and entry separated positions, and the initial and entry angles and mating paths may be mismatched.

Electrical connectors provide a means by which system components may interface with each other and/or with other systems. In most applications, these connectors are handmated and relay on connector components for mated interlock. A general category of connectors called "rack and panel" cannot be handmated due to surrounding structures. This is often apparent in miniaturized systems. The alignment of the connector halves, in this case, is difficult because of small tolerances that are provided. These small tolerances exist between the mating structures and the basic mechanisms. In contrast to the miniaturized systems, highly sophisticated structures are provided in common missile and aircraft designs in which the alignment tolerances are greatly increased due to the relatively larger size of the interfacing structures. Add to this a limited number of interface locations available and it is readily imagined that an electrical interface could be required in a very remote and highly misaligned area. Rack and panel connectors are used in these applications, however the alignment compensating feature must be highly refined. It is in the alignment feature that most designs fall short.

There are basically four directions of misalignment which must be considered: (1) radial, (2) axial, (3) rotational and (4) angular. Three of these conditions can be accounted for without serious complications, but the four in combination pose a difficult problem. The problem is usually solved by compensating for two or three of the conditions in the connector design and by solving the fourth problem through structural design. As usual, reliability and 100 percent guaranteed functional performance are highly important considerations in the design of airborne equipment and, as such, increase the design difficulty.

SUMMARY OF THE INVENTION

The field joint connector set of the present invention solves all four of the said misalignment problems. The size of the connector is determined by the combination of the number of conductors and the extent of the misalignment. It has functional reliability and environmental protection of the active mechanism. This is the reason for its long term reliability. Operational life (accumulated mating and disconnect cycles) is extended by minimizing the forces required to align and mate the connector.

The prior art problems are overcome by the present invention by the following structures acting in a certain sequence of operation as best described in a discussion of the reaction of the active mechanism and a result of the individual misalignment conditions.

1. Axial Separation of Mounting Surfaces—The receptacle has a barrel which is engaged with a plug shell. Electrical engagement of the contacts then begins. An axial force is exerted through a socket insulator in the plug shell. Motion of the plug shell is prohibited via a preload of spring as transferred through a spring plate and shell plate. The force of the preload spring is of such magnitude that full electrical engagement will occur prior to motion of the plug shell. The stroke length of the shell and therefore its ability to accommodate axial vibration is limited only by the length of the spring cavity in the plug housing.

2. Radial Mismatch of Centerlines—Entry of the barrel into the plug shell begins with contact at some point on a lead-in cone of the plug shell. As mating continues, the plug shell is forced sideways (laterally) until the receptacle barrel can enter a constant diameter section of the shell. During this movement, the shell plate and a guidance plate move in their respective cavities. Note that the internal stop shoulder in the plug housing keeps the spring plate from bearing on the shell plate, thereby allowing complete freedom of movement. The only force restricting lateral or radial movement of the plug shell is that of elastomer seals. This force is small compared to the engaging force but sufficiently large to re-center the unmated plug shell. After alignment of barrel to shell, mating continues as described above.

3. Angular Axis Misalignment—As above, initial contact occurs at the plug shell lead-in cone. Lateral or radial motion occurs similarly until the receptacle barrel enters the plug shell constant diameter. As the barrel continues to enter the shell, the shell is forced to assume the angle of the barrel. This action is allowed simply due to the fact that the spring can be compressed non-uniformly without changing the performance characteristics of the connector.

4. Rotational (Clocking) Misalignment—The complexity of correcting rotational misalignment comes not in leading certain barrel keys into shell keyways, but in limiting the rotation of the shell within the housing such that lead-in capabilities of keyways are not exceeded. This is done by machining flats on the plug shell and trapping those flats in a slot in the guidance plate. The plug shell is allowed to move parallel to the slot freely while limiting its rotation in the slot. Motion in the perpendicular direction is provided for by two guide pins riding in two narrow slots in the guidance plate. A close fit between the slot width and the pin diameter allows linear motion parallel to the axis of the pins but allows no rotation of the plate, relative to that axis. The resulting motion allowed the plug shell is a total radial float with limited rotation. Most importantly, the rotational limits are independent of radial location.

Applications

One application for the connector set of the present invention is in all blind mated electrical interface devices for which the accumulation of tolerances for mating alignment is large. Generally speaking, it provides the structural engineer increased latitudes in interface alignment while providing a positive mating electrical interface.

The above-described and other advantages of the present invention will be better understood from the following detailed description when considered in connection with the accompanying drawings.

BRIEF DESCRIPTION OF THE DRAWINGS

In the drawings which are to be regarded as merely illustrative:

FIG. 5 is a top plan view of a retaining ring shown in FIGS. 1 and 4;

FIG. 6 is a perspective view of a plug shell also shown in FIGS. 1, 2, 3 and 4;

FIG. 7 is a sectional view of the connector taken on the line 7—7 shown in FIG. 4;

FIG. 8 is a sectional view similar to FIG. 7 with the parts shown in a position different from the positions in which they are shown in FIG. 7;

FIG. 9 is a front elevational view of the plug shell which is also shown in FIG. 6; and FIG. 10 is an enlarged longitudinal sectional view of a broken away portion of plug shell taken on the line 10—10 shown in FIG. 9.

DESCRIPTION OF THE PREFERRED EMBODIMENT

Figure 1:
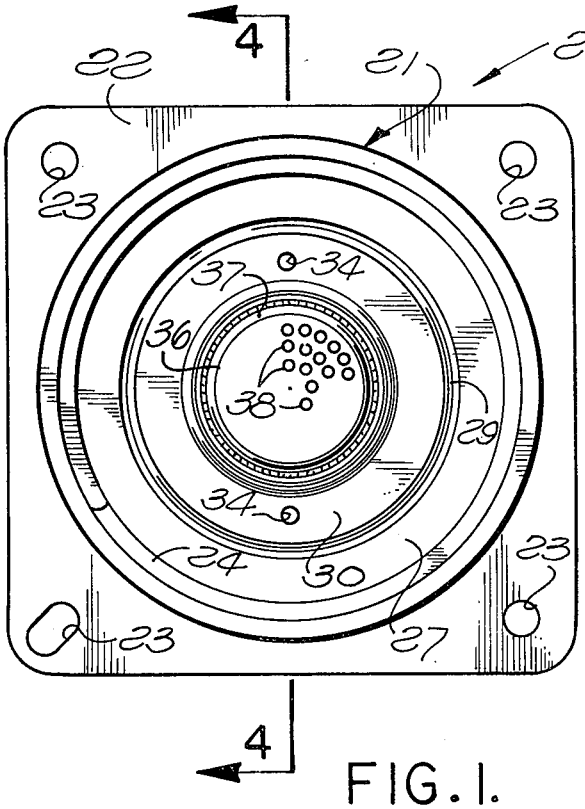
FIG. 1 is a rear elevational view of an electrical connector constructed in accordance with the present invention.

In FIG. 1, the connector of the present invention is illustrated at 20 having a cylindrical housing 21 with a housing flange 22 integral therewith.

The connector 20 may be mounted through the use of holes 23 through housing flange 22.

Figure 4:
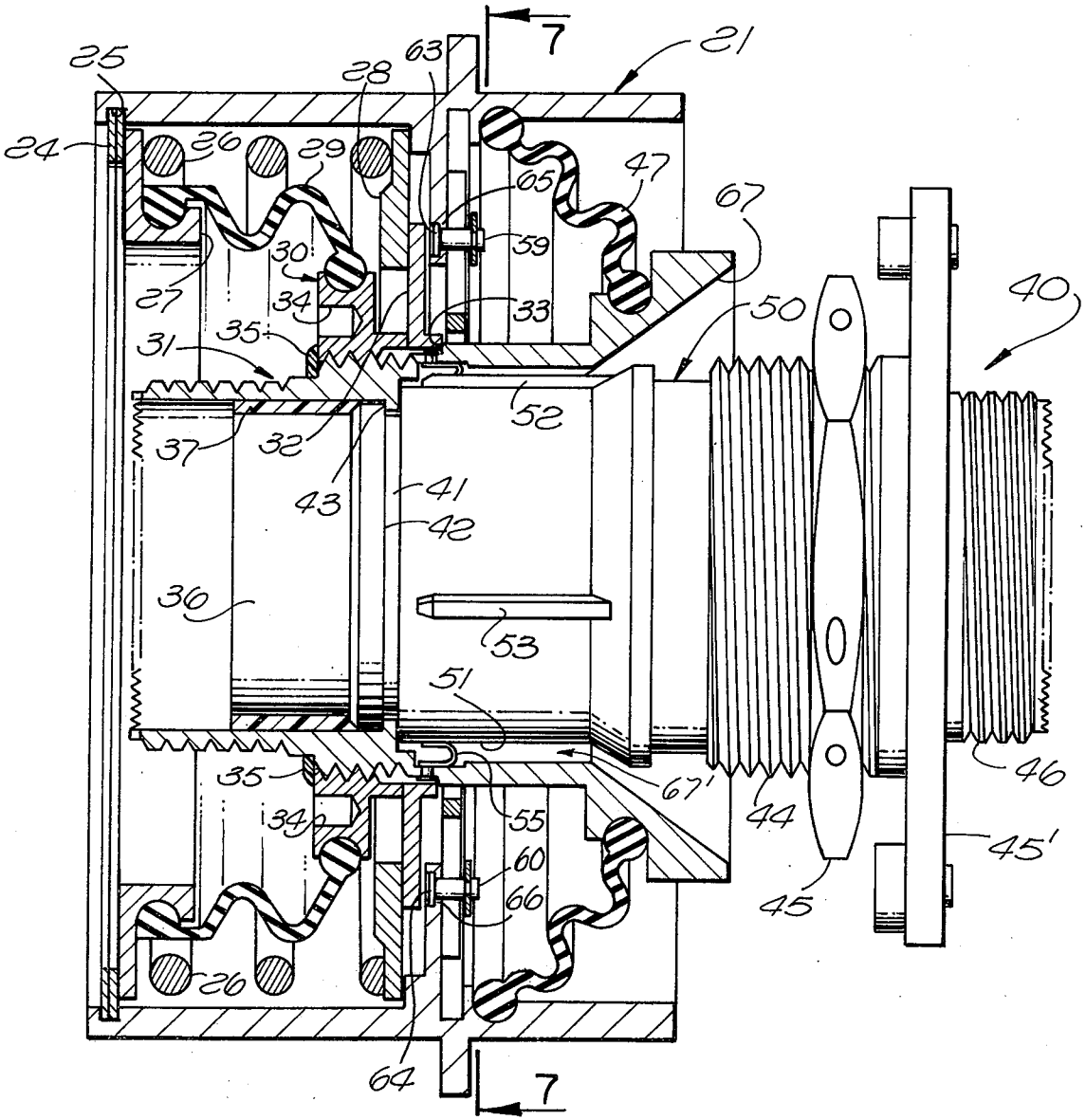
FIG. 4 is a longitudinal sectional view, partly in elevation, taken on the line 4—4 of the connector shown in FIG. 1.

As shown in FIGS. 1, 4 and 5, a retaining ring 24 rests in a groove 25 and holds a coil spring 26 against, and in compression between a rear spring plate 27 and a front spring plate 28.

As shown in FIG. 1, rear spring plate 27 is connected by a rubber bellows 29 to a retainer nut 30 which is threaded tightly on plug shell 31 shown in FIG. 4 and acts as a jam nut to hold a shell plate 32 tightly against a shoulder 33 on plug shell 31.

Retainer nut 30 is threaded to plug shell 31 by means of spanner wrench holes illustrated at 34 in FIGS. 1 and 4.

Retainer nut 30 is also sealed to plug shell 31 at 35 as shown in FIG. 4. An insulator 36 is provided inside plug shell 31 as shown in FIGS. 1 and 4 and is sealed to plug shell 31 by a plastic at 37.

Insulator 36 is provided with holes 38 shown in FIG. 1.

Figure 2:
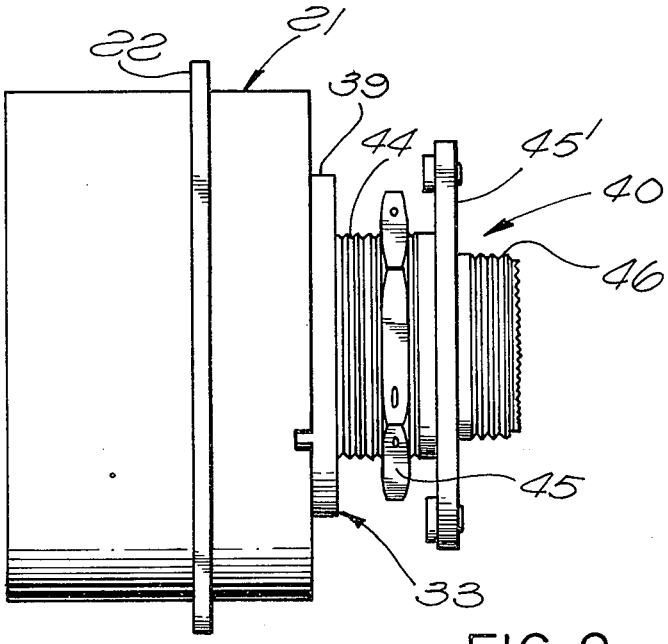
FIG. 2 is a side elevational view of the connector shown in FIG. 1.

Plug shell 31 has a portion 39 projecting outwardly of the interior of housing 21 as shown in FIG. 2. A receptacle is shown at 40 mated with a socket insulator 41 fixed in plug shell 31 by abutment of a shoulder 42 against a flange 43 of plug shell 31 shown in FIG. 4.

Receptacle 40 has a threaded portion 44 on which a jam nut 45 is threaded. Receptacle 40 also has a flange 45′ fixed thereto, and another threaded portion 46 as shown in FIG. 2.

Figure 3:
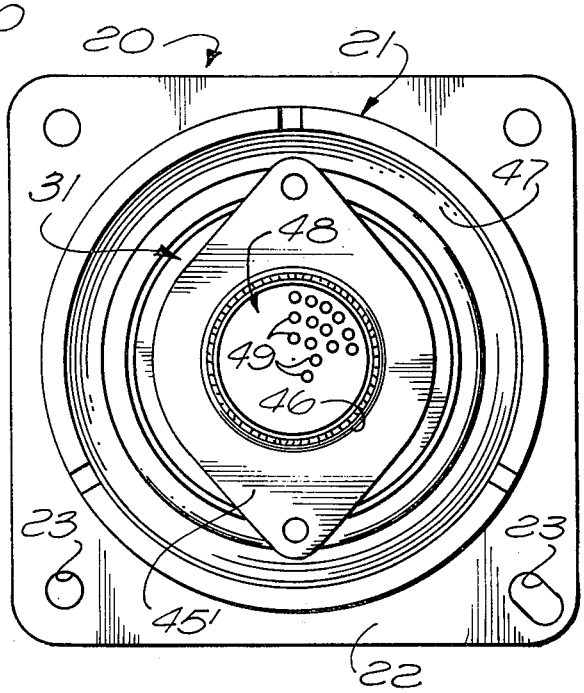
FIG. 3 is a front elevational view of the connector shown in FIGS. 1 and 2.

As shown in FIG. 3, a bellows 47 is connected between housing 21 and plug shell 31.

Receptacle 40 has an insulator 48 fixed therein with holes 49, as shown in FIG. 3.

As shown in FIG. 4, receptacle 40 has a barrel 50 including a portion 51 that carries ribs 52 and 53 (and a third, not shown) as shown in FIG. 4. Rib 52 is larger than the other two ribs to act as a key. Rib 53 and the rib not shown are of the same width. A grounding spring 55 is fixed relative to plug shell 31 and contacts the exterior surface of barrel 50.

Retaining ring 24 shown in FIG. 5 may have approximately 1v turns if desired, as shown in FIG. 5 where the ends of retaining ring 24 are illustrated at 71 and 72.

In FIG. 6, plug shell 31 is shown to have a front portion 73 inside of which a conical surface 67 exists. However, surface 67 cannot be seen in FIG. 6. Bellows 47 fits in a groove 74 of plug shell 31. The groove 74 is shown in FIG. 6, but the rubber bellows 47 is not. As stated previously, bellows 29 is also a rubber bellows. Plug shell flared end 67 is in front of a throat 67′.

As shown in FIGS. 7 and 8, a guidance plate 56 is provided that can move vertically because it is provided with slots 57 and 58 in which guide pins 59 and 60 are disposed, respectively. Each of the pins 59 and 60 are retained by snap rings 61 and 62, respectively. Forward movement of guide pins 59 and 60 is prevented because they have flanges 63 and 64, respectively, which bear against flanges 65 and 66 which are integral with housing 21 (see FIG. 4).

Note will be taken that plug shell 31 has internal surface 67 in FIG. 4, which surface is the surface of a frustum of a cone, except that grooves are provided as will be described hereinafter.

Any conventional means may be employed to hold receptacle 40 with barrel 50 abutting flange 43 on the right side thereof of plug shell 31, as shown in FIG. 4.

The interior of receptacle 40 may be provided with and called a "plug" or a "male member." All that is necessary is that the receptacle 40 mate with whatever is carried inside of plug shell 31 to mate therewith at 41.

Insulator 36 may be a male member or a female member. The male and female members disclosed herein, by themselves, may all be entirely conventional. Except for ribs 52 and 53 and the third of the set, the entire construction inside plug shell 31, except surface 67, and shown in FIG. 4 may be entirely conventional including that portion of receptacle 40 which projects beyond the right end of plug shell 31.

Plug shell 31 has flat portions 75 and 76 in FIG. 6, to be described. Plug shell 31 has a portion 77 to which retainer nut 30 is threaded. Plug shell 31 also has a threaded portion 78 inside of which insulator 36 is located. However, insulator 36 is not shown in FIG. 6.

Receptacle 40 may be introduced into the interior of plug shell 31 even though one or the other is mismatched. This is true because plug shell 31 can move in a great many directions. For example, plug shell 31 can rotate because the flats 75 and 76 are closer together than parallel edges 79 and 80 of guidance plate 56, as shown in FIG. 7. See FIGS. 6, 7 and 8. Note in FIGS. 7 and 8 that flats 75 and 76 are not parallel to parallel edges 79 and 80. The same is true in FIG. 8.

Whether or not flats 75 and 76 are parallel to edges 79 and 80, the curved surface 81 of plug shell 31 has a diameter smaller than the diameters of curved edges 82 and 83 of the approximately rectangular hole through guidance plate 56. This means that plug shell 31 can move to the left or to the right, as viewed in FIGS. 7 and 8.

Still a further movement of plug shell 31 is possible in that guidance plate 56 can move upwardly or downwardly guided by pins 59 and 60 in slots 57 and 58, respectively. Some slight movement upwardly is indicated by guidance plate 56 from the view shown in FIG. 7 to the view shown in FIG. 8.

Flared portion 67 of plug shell 31 is shown in FIG. 9 with grooves 68, 69 and 70 to accommodate ribs 52, 53 and the rib not shown, respectively.

As shown in FIG. 10, grounding spring 55 may be fixed relative to plug shell 31 through one or more holes 84 therethrough.

The axis of plug shell 31 may also tilt relative to housing 21 as shown in FIG. 4. This can occur when a force is applied to plug shell 31 by receptacle 40 tending to tilt the same. Shell plate 32 then will press against front spring plate 28 and cause it to move to an angle other than 90° relative to the axis of housing 21. The same is true even though spring 26 yieldingly resists tilting of front spring plate 28.

In FIG. 9, it will be noted that grooves 68, 69 and 70 may each be described as being actually two grooves. For example, a transverse plane through lines 68', 69' and 70' upwardly away from the plane of the drawing of FIG. 9 in the slots 68, 69 and 70 may be described as: "First grooves of tapering widths opening into corresponding second grooves of constant widths." In this case the first grooves are those portions of the grooves 68', 69' and 70' above the plane of the lines 68', 69 and 70' as stated previously, these grooves being formed in the flared portion 67 of the plug shell 31. The "second grooves" may be employed to describe the portions of the grooves 68, 69 and 70 below or on the opposite side of the plane of the lines 68', 69' and 70'.

In FIG. 4, plug shell 31 may be described as: "having a flared end preceded by a throat." The flared end is the flared end portion 67. The "throat" is that portion of plug shell between portion 67 and the left end of ribs 52 and 53.

The phrase: "first means mounting said plug shell through said housing opening in a manner such that a point on said plug shell can translate in any two directions simultaneously or independently in a plane perpendicular to said housing axis" has its ordinary meaning. For example, "translational motion" and "rotational motion" are described on pages 610 and 611, respectively, of the McGraw-Hill *Encyclopedia of Science and Technology*, Volume 11, copyright 1960, 1966 and 1971. The plug shell mentioned in the previous quotation is, of course, the plug shell 31. The housing mentioned therein is the housing 21. The housing 21 has an opening through which plug shell 31 is mounted as shown in FIG. 4. A point on plug shell 31 can obviously translate in any two directions because the plug shell 31 shown, for example, in FIGS. 7 and 8 can move from left to right, and vice versa, up and down, at an angle other than zero degrees with respect to the horizontal, and in the reverse direction. This is because plug shell 31 is loosely mounted in between edges 79 and 80 of guidance plate 56, and between edges 82 and 83 thereof, whereas guidance plate 56 itself is movable vertically upwardly and vertically downwardly because the slots 57 and 58 thereof are slidable upwardly and downwardly over the respective pins 59 and 60. It will be recalled that pins 59 and 60 have flanges 63 and 64, respectively, which bear against flanges 65 and 66 that are integral with housing 21. See FIG. 4. Thus, flanges 63 and 64, with snap rings 61 and 62, hold pins 59 and 60 in substantially fixed axial positions relative to housing 21 as shown in FIG. 4.

A "connector member" means a plug or socket.

In the claims terms like "electrical connector" followed by (20) mean, for example, "electrical connector (e.g. 20)."

I claim:

1. An electrical connector comprising: a housing having an approximately symmetrical longitudinal axis therethrough and having an opening completely therethrough; a contact carrying plug shell; a guidance plate having a pair of slots therein, said guidance plate having an approximately rectangular hole therein surrounding said plug shell, said plug shell having undersize parallel flats on opposite outside surfaces thereof at said guidance plate location to rotate therewithin; a pair of guide pins substantially fixed to said housing on opposite sides thereof, said pins being located in respective ones of said slots, said slots extending generally in a line normal to the lengthwise dimension of said guidance plate hole; a forward rubber bellows fixed between said housing and said plug shell covering said guidance plate at the forward end of said housing; a retaining ring fixed to the other end of said housing; a rear spring plate bearing against said retaining ring forward thereof; a front spring plate forward of said rear spring plate inside said housing; a helically coiled spring in compression between said rear and front spring plates, said housing having a shoulder to limit forward movement of said front spring plate; a shell plate fixed relative to said plug shell, said housing having an annular recess forward of said front spring plate, said shell plate being slidable on said front spring plate in said recess; and a rear rubber bellows fixed between said rear spring plate and said plug shell.

* * * * *